United States Patent [19]

Reigel et al.

[11] Patent Number: 4,882,902

[45] Date of Patent: Nov. 28, 1989

[54] TURBINE COOLING AIR TRANSFERRING APPARATUS

[75] Inventors: James R. Reigel; Robert J. Corsmeier; James H. Bertke; Dean T. Lenahan, all of Cincinnati, Ohio

[73] Assignee: General Electric Company, Cincinnati, Ohio

[21] Appl. No.: 168,522

[22] Filed: Mar. 7, 1988

Related U.S. Application Data

[63] Continuation of Ser. No. 857,282, Apr. 30, 1986, abandoned.

[51] Int. Cl.[4] ..... F02C 3/00; F01D 5/14

[52] U.S. Cl. ..... 60/39.75; 415/115

[58] Field of Search ..... 60/39.75, 39.83; 416/95; 415/115

[56] References Cited

U.S. PATENT DOCUMENTS

| | | | |
|---|---|---|---|
| 2,750,147 | 6/1956 | Smith | 416/95 |
| 2,988,325 | 6/1961 | Dawson | 415/115 |
| 3,565,545 | 2/1971 | Bobo et al. | 416/90 |
| 3,814,539 | 6/1974 | Klompas | 416/95 |
| 3,980,411 | 9/1976 | Crow | 415/115 |
| 4,178,129 | 12/1979 | Jenkinson | 416/95 |
| 4,217,755 | 8/1980 | Williams | 60/39.75 |
| 4,236,869 | 12/1980 | Laurello | 416/95 |
| 4,425,079 | 1/1984 | Speak et al. | 416/95 |
| 4,655,680 | 4/1987 | Klepesch | 415/90 |
| 4,657,482 | 4/1987 | Neal | 60/39.83 |

FOREIGN PATENT DOCUMENTS

| | | | |
|---|---|---|---|
| 207378 | 7/1956 | Australia | 416/95 |
| 1137715 | 6/1957 | France | 416/4 |
| 1234737 | 10/1960 | France | 416/95 |
| 764018 | 12/1956 | United Kingdom | 415/115 |
| 2075123 | 11/1981 | United Kingdom | 60/39.75 |

*Primary Examiner*—Donald E. Stout

*Attorney, Agent, or Firm*—Steven J. Rosen; Jerome C. Squillaro

[57] ABSTRACT

An improved system provides cooling air to the turbine blades of a gas turbine engine. The improved system includes the combination of an inducer to receive pressurized cooling air from the compressor and then to direct this cooling air in a substantially tangential direction to a radial flow impeller which includes an air seal. Cooling air is directed to the turbine blades which are mounted on the rim of the rotating first turbine disk. In a preferred embodiment of the invention, a second portion of the cooling air from the inducer is conveyed through a deswirler to introduce the cooling air into a circumferential channel surrounding the rotor shaft. The cooling air is then directed to a second inducer means which is mounted on the higher pressure turbine disk. The cooling air is then directed to a second annular impeller mounted on the lower pressure turbine disk to convey this portion of cooling air to the lower pressure turbine rotor blades.

4 Claims, 2 Drawing Sheets

TURBINE COOLING AIR TRANSFERRING APPARATUS

The Government has rights in this invention pursuant to Contract No. F33657-81-C-2006, awarded by the Department of the Air Force.

The present invention is directed to improvements in gas turbine engines and, more particularly to improved cooling of the turbine blades of gas turbine engines.

This is a continuation of application Ser. No. 857,282, filed 4/30/86, now abandoned.

BACKGROUND OF THE INVENTION

Gas turbine engines conventionally comprise a compressor for pressurizing air to support combustion of fuel to generate a hot gas stream. This hot gas stream drives a turbine connected to the compressor, and is then utilized to obtain a propulsive output or a powered shaft output from the engine. In order to obtain higher operating efficiencies and power outputs, the hot gas stream, when it passes through the turbine, is frequently at a temperature exceeding the physical capabilities of the materials from which the turbines are fabricated, particularly considering the high stresses which are imposed on the turbine rotor. This has led to many proposals for providing cooling systems for the turbine, particularly for those portions exposed to the hot gas stream. Generally, it has been the practice to direct relatively cool air from the engine compressor to the turbine blades, along a path distinct from the hot gas stream, in order to provide the required cooling of the blades. One of the problems which is encountered in such cooling systems, however, is in the mechanism for conveying the cooling air from the compressor to the turbine which is rotating at high speed, and then to the turbine rotor blades themselves.

One system which has been employed to provide air cooling to the turbine blades has involved using a large diameter annular seal somewhat forward to the turbine disk to form a chamber between the annular seal and the disk to receive cooling air from the compressor and convey it to the turbine blades which are mounted on the rim of the turbine disk. Systems of this type, however, are inherently heavy because of the large diameter of the annular seal and are also subject to substantially large air leakage. Other systems have involved the use of annular seals of relatively smaller diameter to form correspondingly smaller annular chambers between the seal and the turbine disk with the cooling air being passed from the smaller annular chamber by means of an impeller mounted on the seal along the surface of the disk to the turbine blades. While systems of this type avoid some of the leakage encountered using the larger annular seals, they are still relatively heavy and require that the annular seal support a relatively large load in the form of the impeller unit.

OBJECTS OF THE INVENTION

It is an object of the present invention to provide an improved system for conveying cooling air to the turbine blades of a gas turbine engine.

Another object of the present invention is to provide an improved system for conveying cooling air to the turbine blades which avoids the need for large diameter annular seals and reduces seal air leakage.

Another object of the present invention is to provide an improved system for conveying cooling air to the turbine blades which avoids placing cooling holes or slots directly in the disk itself thereby maintaining the structural strength of the disk.

Still another object of the present invention is to provide an improved system for conveying cooling air from the high pressure turbine disk to the low pressure turbine disk which avoids the need for a compressor interstage air supply system and external piping.

These and other objects of the invention, together with the features and advantages thereof, will become apparent from the following detailed specification when read in conjunction with the accompanying drawings in which applicable reference numerals have been carried forward.

SUMMARY OF THE INVENTION

The present invention is for use in a gas turbine engine which includes a turbine disk from which blades project radially into a hot gas stream, a compressor effective for providing pressurized cooling air and a cooling air transferring apparatus for transferring cooling air from the compressor to the turbine. The cooling air transferring means comprises an inducer means, effective for channeling the cooling air in a direction substantially tangentially to the turbine disk and a radial impeller means discrete from the turbine disk for receiving the cooling air and conveying it to the blades.

In a particular embodiment of the invention, the cooling air transferring apparatus includes a second inducer means which is effective for channeling a second portion of cooling air in a direction generally tangential to a direction of a second turbine disk and a second radial impeller means discrete from the second turbine disk effective for receiving the second portion of cooling air and conveying it to the blades.

BRIEF DESCRIPTION OF THE DRAWINGS

The invention, together with further objects and advantage thereof, is more particularly described in the following detailed description taken in conjunction with the accompanying drawings in which.

DETAILED DESCRIPTION OF THE INVENTION

Figure 1:
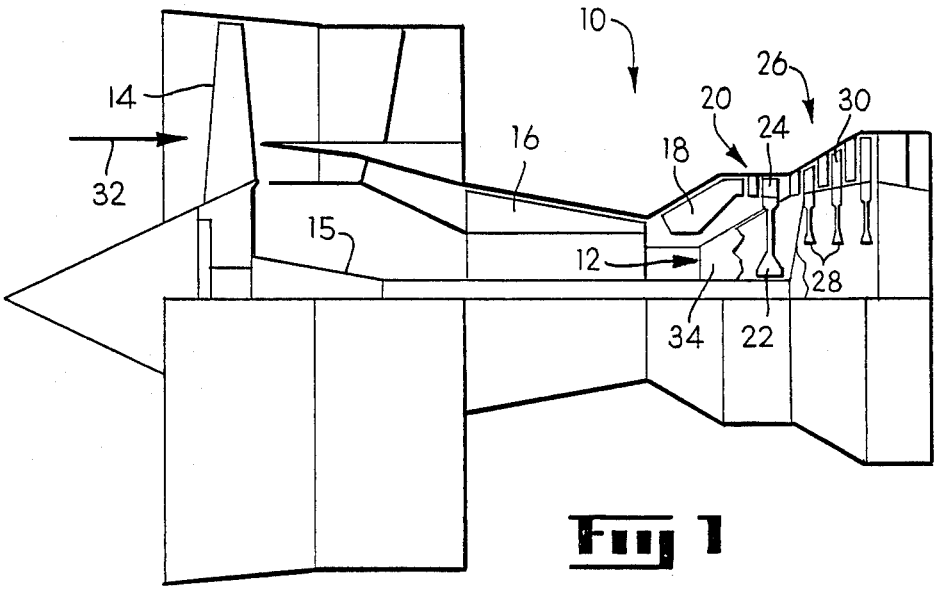
FIG. 1 is a cross-secton of a gas turbine engine having high and low pressure turbine disks.

Illustrated in FIG. 1 is an axial flow gas turbine engine shown generally at 10, including a cooling air transferring apparatus generally located at 12, according to one embodiment of the present invention. The engine 10 includes in serial flow relationship fan 14, a compressor 16, a combustor 18, a high pressure turbine 20 including a high pressure turbine disk 22 having a plurality of circumferentially spaced high pressure turbine blades 24 extending radially outwardly therefrom, and a low pressure turbine 26 including low pressure turbine disk 28 having a plurality of circumferentially spaced low pressure turbine blades 30 extending radially outwardly therefrom.

In conventional operation, inlet air 32 is pressurized by the compressor 16. A major portion of the inlet air 32 is then suitably channeled into the combustor 18 where it is mixed with fuel for generating relatively high pressure combustion gases which flow to the high pressure turbine 20 for providing power to the compressor 16 through an interconnecting shaft 34. The combustion gases then pass through a low pressure turbine 26 for providing power to a low pressure compressor (not shown) and/or a fan 14 through an interconnecting shaft 15 and are then discharged from the engine 10.

Figure 2:
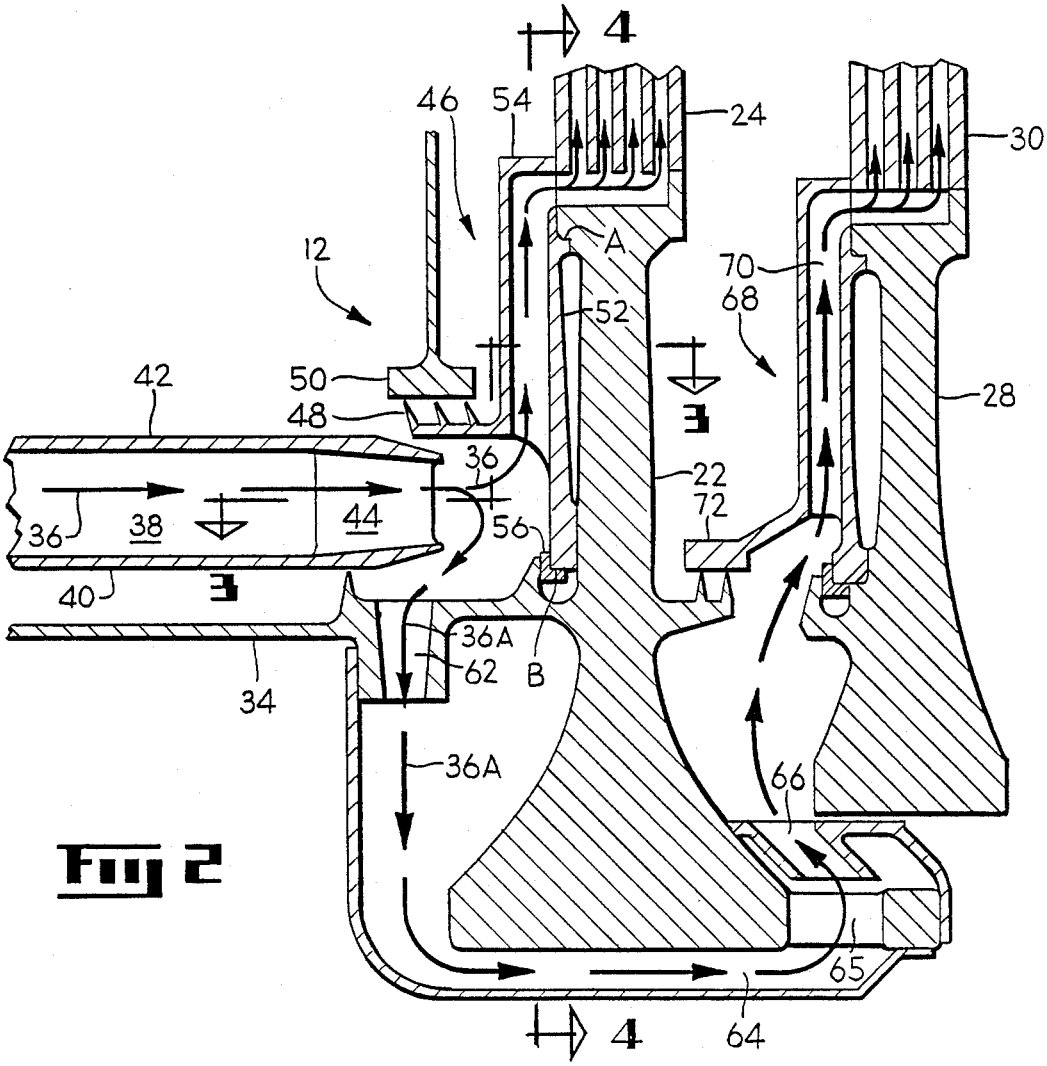
FIG. 2 is a partial view showing the cooling air transferring apparatus.

A portion of the pressurized inlet air 32 that is discharged from the compressor 16 is used for providing pressurized cooling air 36, shown in FIG. 2, for cooling the rotor components which are surrounded by the combustion discharge gases. The cooling air 36 is channeled to the air transferring apparatus 12 by an annular inner duct 38 defined by an inner combustor casing (not shown) and a turbine nozzle support structure 40 and 42.

Figure 3:
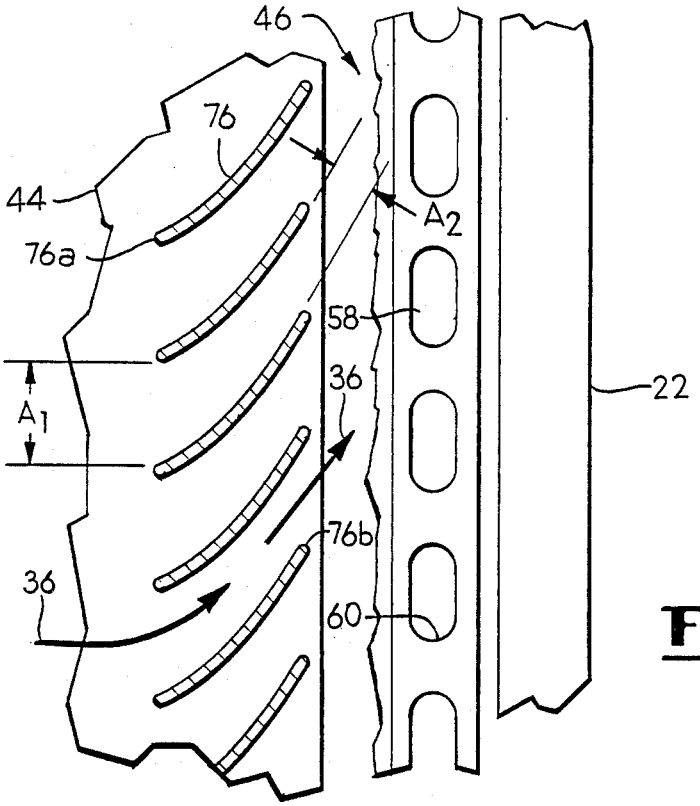
FIG. 3 is a partial cutaway view of the inducer of the invention and a partial cutaway view end-on of the impeller of the invention.

The air transferring apparatus according to one embodiment of the invention, and shown in FIGS. 2 and 3, includes an annular inducer means 44 and is effective for channeling cooling air 36 in a direction substantially tangential to the high pressure turbine disk 22 and into radial impeller 46 mounted on the high pressure turbine disk 22 at points A and B.

Annular inducer means 44, as shown in FIG. 3, includes vanes 76 conventionally sized for accelerating cooling air 36 to a velocity substantially equal to the tangential velocity of impeller 46. More specifically, the leading and trailing edges 76*a* and 76*b*, respectively, of adjacent vanes 76 define inlet and outlet cross-sectional flow areas A1 and A2, respectively. the inlet flow area A1 is suitably sized greater than the outlet area A2 for suitably accelerating cooling air 36.

Cooling air 36 is then directed through a discrete impeller 46 to the high pressure turbine blades 24, as shown in FIG. 2, to provide cooling thereto. An annular labyrinth seal 48 is disposed on the forward side of impeller 46 to provide an air seal between the stationary structure 50 and the rotating high pressure turbine disk 22 and impeller 46. Impeller 46 is provided with aft and forward annular flanged walls 52 and 54 respectively. Flange wall 52 conveniently provides attachment of the impeller to the high pressure turbine disk 22 by means of an annular retaining ring 56, while outer flange wall 54 fits against disk 22 and the root of the high pressure turbine blade 24 and provides a sealing element at its inside diameter.

Figure 4:
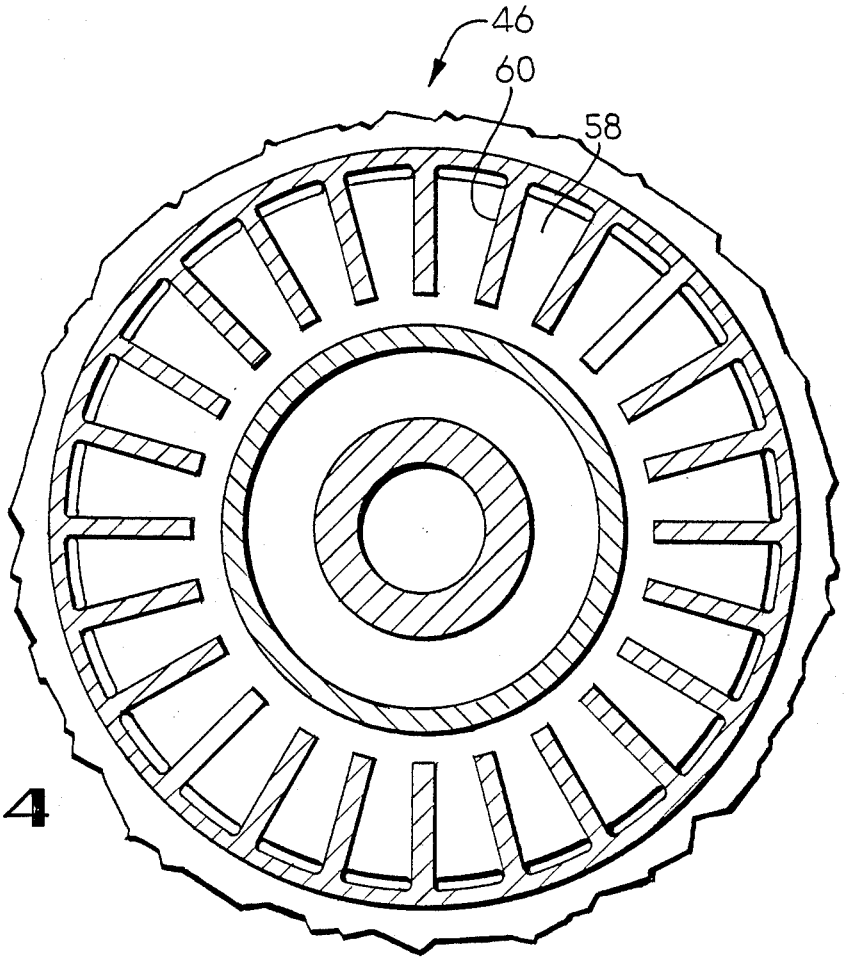
FIG. 4 is a partial cutaway view of the impeller of the invention.

Referring to FIGS. 3 and 4, radial impeller 46 consist essentially of a ring shaped disk having radial channels or passages 58 for increasing the pressure by centrifugal pumping and for conveying the cooling air 36 to the turbine blades 24 (shown in FIG. 2). The radial passageways 58 in the impeller 46, which are, of course, open at both ends to permit passage of air, are otherwise fully enclosed. The passageways 58 may, in fact, be generally elliptical, round or otherwise shaped cross section passages separated from one another by only a thin radial partition or web 60 to maintain the structural strength and form of the impeller 46. It will, in this regard, be understood that the cross section configuration of the impeller 46 should provide a passage so that the required amount of pressurized cooling air 36 (shown in FIG. 2) is conveyed to the high pressure turbine blades 24 (shown in FIG. 2) with reasonably low loss in pressure.

Referring to FIG. 2, the inducer-impeller combination of the present invention, allows the cooling air pressure at the inducer discharge to be reduced below that required without an impeller 46. This lower pressure provides lower air leakage flow out through the annular labyrinth seal 48 with less adverse effect on turbine efficiency. In addition, the lower inducer discharge pressure allows increased inducer pressure ratio and discharge Mach number. The resultant increase in tangential flow velocity leaving the inducer 44 reduces the work required to be done by the turbine on the cooling air 36 in getting the flow into the impeller passages 58 (shown in FIGS. 3 and 4).

If the tangential velocity of the air leaving the inducer 44 is greater than the speed of the turbine disk 22, work is done on the disk resulting in a turbine efficiency improvement plus an added benefit of reduced cooling air temperature at the entrance to the blades 24. The inducer-impeller combination also eliminates any mismatch between the disk speed and the cooling air tangential velocity at the entrance to blades 24, thereby eliminating pressure losses associated with getting flow into blades 24.

In an alternative embodiment of the turbine cooling air transferring apparatus 12, as shown in FIG. 2, a second portion 36A of the pressurized cooling air 36 is directed to a deswirler 62 in order to aerodynamically change the direction of flow of the cooling air 36A and guide the air into annulus 64 located inward of the high pressure turbine disk 22. The deswirler 62 is directly attached to the interconnecting shaft 34 so it rotates in exactly the same manner. This feature enables the deswirler 62 to reduce the tangential velocity of cooling air 36A to match the tangential velocity of high pressure turbine disk 22 while maintaining its angular momentum. Cooling air 36A is then directed through a series of holes 65 to a second rotating inducer 66. Second inducer 66 is effective for directing cooling air 36A in a direction substantially tangential to low pressure turbine disk 28. Inducer 66 is also effective for extracting some of the pressure energy contained in cooling air 36A and converting it into work to help drive the high pressure turbine disk 22. By transferring some of the energy of the air to the turbine, a reduction in the cooling air temperature is accomplished. Reduced cooling air temperature permits a reduction in cooling airflow, thereby improving turbine efficiency and engine performance.

Between second inducer 66 and the inlet to a second annular impeller 68 which is discrete from the second turbine disk, the angular momentum of cooling air 36A is generally maintained while the tangential velocity decreases until reaching the second annular impeller 68, where the tangential velocity of cooling air 36A and the low pressure turbine disk 28 are substantially equal.

Impeller 68 is mounted on the low pressure disk 28 and is provided with passages 70 through which cooling air 36A passes to the rim of the low pressure turbine disk 28 and then to low pressure turbine blades 30. A forward facing seal 72 is provided on the forward side of the impeller 68 to engage the seal mounted between the high pressure turbine disk 22 and the low pressure turbine disk 28.

It will be appreciated, that the use of the radial impeller of the present invention has the advantage of avoiding any need for large diameter, heavy seals and minimizes air leakage by placing the seal provisions relatively close to the central, concentric rotating shafts of the engine. In addition, the use of an inducer-impeller combination is effective for directing cooling air to rotating turbine blades without placing cooling holes or slots directly in the rotor disk itself, thereby maintaining the structural strength of the disk. Furthermore, the inducer-impeller combination of the low pressure turbine allows cooling air to be conveyed to the low pressure turbine without the need for a compressor interstage air supply system and external piping.

The impeller of this invention also avoids prior art practices of providing cooling holes or slots directly in the turbine disk itself, which weaken the structure, and, at the same time, avoids the inefficiency of mounting the impeller structure or its equivalent on a separate member with only one disk-like or flanged wall structure. The present invention therefore offers the substantial advantage of increased engine performance, greater structural strength, and reduced air leakage.

It will be clear to those skilled in the art that the present invention is not limited to the specific embodiments described and illustrated herein.

It will be understood that the dimensions and proportional and structural relationships shown in the drawings are by way of example only, and these illustrations are not to be taken as the actual dimensions or proportional structural relationships used in the turbine cooling air transferring means of the present invention.

Numerous modifications, variations, and full and partial equivalents can be undertaken without departing from the invention as limited only by the spirit and scope of the appended claims.

What is desired to be secured by Letters Patent of the United States is the following.

What is claimed is:

1. A gas turbine engine cooling air transferring means including a turbine disk from which blades project radially into a hot gas stream; a compressor effective for providing pressurized cooling air; and a cooling air transferring apparatus for transferring cooling air from the compressor to the turbine disk, separate from the hot gas stream, wherein the cooling air transferring means comprises in combination:

an inducer means effective for channeling the cooling air in a direction substantially tangential to said turbine disk;

a radial impeller means for receiving said cooling air and conveying it to said blades;

said impeller means comprising a plurality of radial passages enclosed within said impeller for receiving the cooling air and a mounting means for mounting said impeller to said turbine disk; and wherein said impeller means includes an annular forward facing side and an annular rearward facing side wherein one side is mountable to the turbine disk and the other side includes an annular air seal.

2. The cooling air transferring apparatus of claim 1 wherein said annular air seal is a labyrinth seal.

3. A gas turbine engine cooling air transferring apparatus for a gas turbine engine including a compressor effective for providing pressurized cooling air; first and second turbine disks connected to first and second coaxially spaced shafts interconnecting said compressor to said turbine disks; wherein the cooling air transferring apparatus for transferring cooling air from the compressor to the turbine disks comprises in combination:

an inducer means effective for channeling a first portion of said cooling air substantially tangentially to said first turbine disk and for channeling a second portion of said cooling air to a deswirler means;

a first radial impeller means effective for receiving said first portion of said cooling air and conveying it to said blades;

a second radial impeller means effective for receiving said second portion of said cooling air and conveying it to said blades;

wherein said first and second impeller means each include a plurality of radial passages for receiving said cooling air and conveying it to said respective blades; and the cooling air transferring apparatus to said radial passages are enclosed within said first and second impeller means;

wherein said second portion of said cooling air is directed through a second inducer means to said second annular impeller; and wherein said second inducer means is attached to said first turbine disk, is effective for extracting some of the pressure energy contained in said second portion of said cooling air and for converting said energy into work to help drive said first turbine disk.

4. A gas turbine engine cooling air transferring means including a turbine disk from which blades project radially into a hot gas stream; a compressor effective for providing pressurized cooling air; and a cooling air transferring apparatus for transferring cooling air from the compressor to the turbine disk, separate from the hot gas stream, wherein the cooling air transferring means comprises in combination;

an inducer means effective for channeling the cooling air in a direction substantially tangential to said turbine disk;

a radial impeller means for receiving said cooling air and conveying it to said blades;

wherein said impeller means comprises a plurality of radial passages enclosed within said impeller for receiving the cooling air; and a mounting means for mounting said impeller to said turbine disk comprising an annular flange at a first radius of said turbine disk on a side of said turbine disk facing said impeller and a retaining ring engaging said impeller and turbine disk at a smaller second radius of said turbine disk.

* * * * *